US005401937A

United States Patent [19]

Nagano

[11] Patent Number: 5,401,937

[45] Date of Patent: Mar. 28, 1995

[54] SHEATHED HEATER

[75] Inventor: Shigetoshi Nagano, Tokyo, Japan

[73] Assignee: Sakaguchi Dennetsu Kabushiki Kaisha, Tokyo, Japan

[21] Appl. No.: 183,501

[22] Filed: Jan. 18, 1994

[51] Int. Cl.[6] ..... H05B 3/48

[52] U.S. Cl. ..... 219/544; 219/546; 219/550; 338/261

[58] Field of Search ..... 219/544, 546, 550; 338/295, 302, 303, 261, 240, 241, 268, 270

[56] References Cited

U.S. PATENT DOCUMENTS

| | | | |
|---|---|---|---|
| 1,533,096 | 4/1925 | Bullinger | 338/266 |
| 1,976,624 | 10/1934 | Mucher | 338/261 |
| 2,213,887 | 9/1940 | Ross | 338/261 |
| 2,993,186 | 7/1961 | Hay | 338/261 |
| 3,882,297 | 5/1975 | Avalon | 338/302 |
| 4,039,996 | 8/1977 | Handerhan | 338/295 |

*Primary Examiner*—Teresa J. Walberg
*Attorney, Agent, or Firm*—Nilles & Nilles

[57] ABSTRACT

A sheathed heater having a cylindrical metal sheath includes at least two rod shaped insulator core pieces that are separated from each other and inserted into the sheath along an axial direction of each core piece. Two or three lead pins separated from each other are inserted into the core pieces axially, and an internal heater coil segment is wound around each core piece. Adjacent ends of adjacent internal heater coil segments are electrically connected to the same lead pin, and the coil segments are connected across a single-phase or three-phase electric power source through the lead pins. A thermal and electric insulation material can be inserted between adjacent core pieces.

6 Claims, 3 Drawing Sheets

SHEATHED HEATER

BACKGROUND OF THE INVENTION

1. Field of the Invention

This invention relates to a sheathed heater, and more particularly to an improvement of a sheathed heater for use in a higher temperature atmosphere.

2. Description of the Prior Art

The conventional sheathed heater to be connected across a single-phase power source, as shown in FIG. 1, comprises a metal pipe 1, such as a stainless steel pipe, a core of porcelain insulator 2 made of magnesia or the like and arranged at the center of the metal pipe 1, a pair of lead pins 3*a*, 3*b* having base portions which are inserted into small holes formed in and passing through said core of porcelain insulator 2, an internal heater coil 4 wound around said core of porcelain insulator 2 and a thermal and electrical insulation material 5 of magnesia or the like filled in a space formed between the metal pipe 1 and the core of porcelain insulator 2, both ends of said internal heater coil 4 being electrically connected to said pair of lead pins 3*a*, 3*b*, respectively. Such a sheathed heater is reduced in diameter by a subsequent swaging process.

In such a conventional sheathed heater, however, if the length thereof is too long the sheathed heater tends to bend when it is subjected to said swaging process. Accordingly, it was contemplated to divide axially the core of porcelain insulator 2 into two or more core pieces, for example, into three core pieces 2*a*~2*c*, and a planar spacer 6 of magnesia or the like is inserted between adjacent core pieces, as shown in FIG. 2.

Further, in the conventional sheathed heater, the heater coil 4 has a limitation in length due to the diameter of the heater coil wire and the value of voltage applied thereto. Accordingly, said heater coil 4 is also divided into three heater coil segments 4*a*~4*c*, each wound around a core piece 2*a*~2*c*, and the voltage of a single-phase power source is applied by said lead pins 3*a*, 3*b* to the both ends of each heater coil segment 4*a*, 4*b* or 4*c*. Specifically, as shown in FIG. 2, one end A1, A2 or A3 of the heater coil segment 4*a*, 4*b* or 4*c* is connected to one of said lead pins 3*a*, 3*b* at one end of each of the core pieces 2*a*, 2*b* or 2*c*, and the other end B1, B2 or B3 of each heater coil segment 4*a*, 4*b* or 4*c* is connected to the other of said lead pins 3*a*, 3*b* at the other end of each of the core pieces 2*a*, 2*b* or 2*c*.

FIG. 3 shows a conventional sheathed heater to be connected across a three-phase power source.

It is publicly known that in the sheathed heater the insulation ability of the thermal and electrical insulation material 5 and the spacer 6 of magnesia or the like is lowered if the temperature is increased to more than about 800° C. However, in the sheathed heater as shown in FIG. 2 or FIG. 3, a gap formed between the adjacent core pieces becomes a non-heated portion, so that the gap should be made small, such as about 2 to 3 mm in order to equalize the temperature distribution. If this is the case, a voltage, such as 100 V is applied between said gap, so that an abnormal current flows through said gap to heat this portion, thereby causing the service life of the sheathed heater to be shortened.

SUMMARY OF THE INVENTION

An object of the present invention is to reduce an abnormal current flowing through a gap formed between adjacent core pieces.

The above object can be attained by a sheathed heater characterized in that each internal heater coil segment is wound around each core piece arranged axially, which is covered by a cylindrical metal sheath through a thermal and electrical insulation material, and adjacent ends of adjacent internal heater coil segments are connected to the same lead pin, or lead pins of the same electric potential.

The above object can also be attained by a sheathed heater comprising a cylindrical metal sheath, a plurality of rod shaped core pieces of porcelain insulator arranged side by side in said cylindrical metal sheath, a thermal and electrical insulation material filled in a space formed between said metal sheath and core pieces, internal heater coil segments each wound around each of said core pieces, and a plurality of lead pins each inserted into said core pieces, characterized in that adjacent ends of adjacent internal heater coil segments are connected to the same lead pin, or lead pins of the same electric potential.

The above object can also be attained by a sheathed heater comprising a cylindrical metal sheath, a plurality of rod shaped core pieces of porcelain insulator arranged side by side in said cylindrical metal sheath, spacers of thermal and electrical insulation material each inserted between adjacent core pieces, a thermal and electrical insulation material filled in a space formed between said metal sheath and core pieces, internal heater coil segments each wound around each of said core pieces, and a plurality of lead pins each inserted into said core pieces and spacers, characterized in the adjacent ends of adjacent internal heater coil segments are connected to the same lead pin, or lead pins of the same electric potential.

DESCRIPTION OF THE PREFERRED EMBODIMENTS

Now, an embodiment of this invention will be described by referring to FIGS. 4 to 6.

Figure 1:
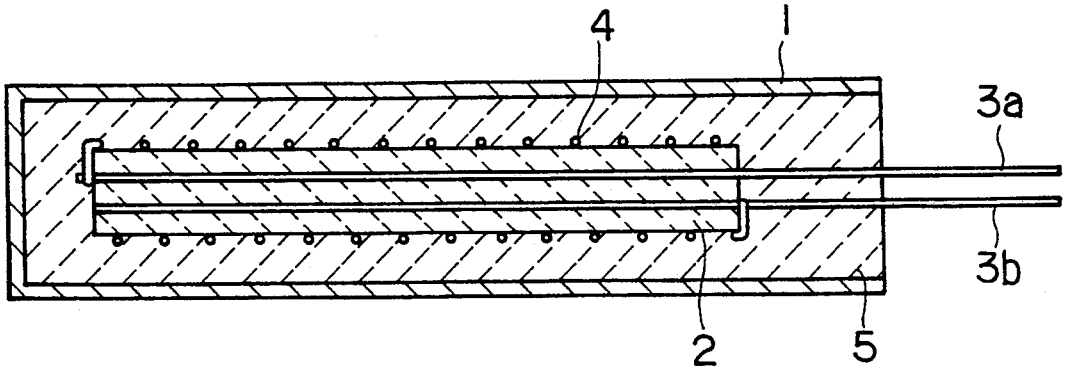
FIG. 1 PRIOR ART
FIG. 1 is a sectional view of a conventional sheathed heater to be connected across a single-phase electric power source.
Figure 2:
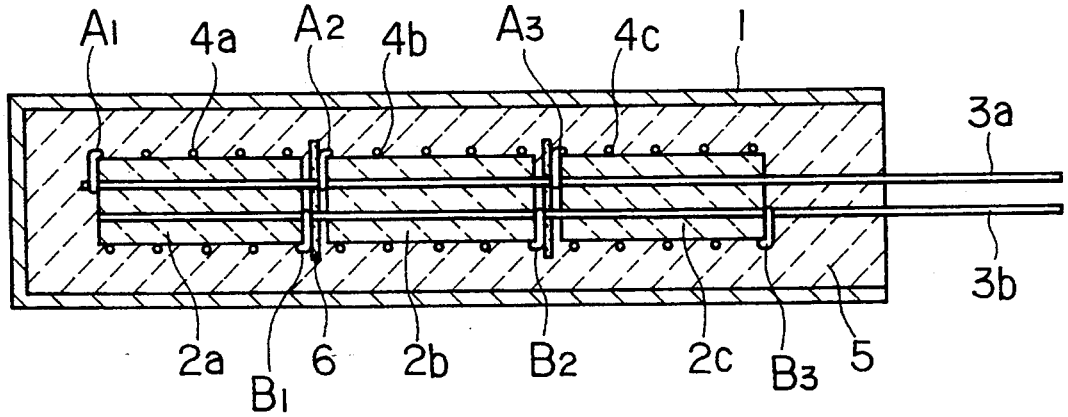
FIG. 2 PRIOR ART
FIG. 2 is a sectional view of an another conventional sheathed heater to be connected across a single-phase electric power source.
Figure 3:
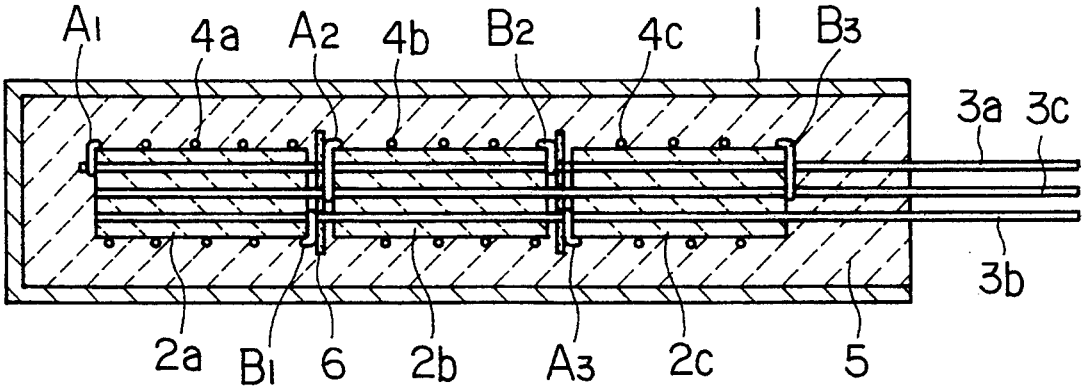
FIG. 3 PRIOR ART
FIG. 3 is a sectional view of an other conventional sheathed heater to be connected across a three-phase electric power source.
Figure 4:
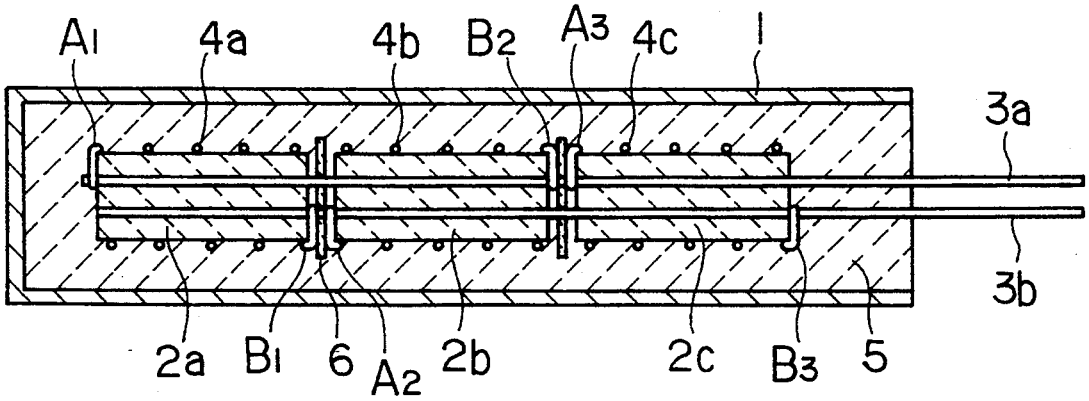
FIG. 4 is a sectional view of a sheathed heater to be connected across a single-phase electric power source according to an embodiment of the present invention.

In a sheathed heater to be connected across a single-phase electric power source according to an embodiment of the present invention, as shown in FIG. 4, one end A1 of a first internal heating coil segment 4*a* wound around a first core piece 2*a* is electrically connected to one lead pin 3*a* at one end of said first core piece 2*a*, whereas the other end B1 of said first internal heater coil segment 4*a* is electrically connected to the other lead pin 3*b* at the other end of said first core piece 2*a*. An end A2 of a second internal heating coil segment 4*b* wound around a second core piece 2*b* adjacent to said first core piece 2*a* is electrically connected to said other lead pin 3*b* at one end of said second core piece 2*b*, whereas, the other end B2 of said second internal heating coil element 4*b* is electrically connected to said one lead pin 3*a* at the other end of said second core piece 2*b*.

Similarly, an end of A3 of a third internal heating coil segment 4*c* wound around a third core piece 2*c* adjacent to said second core piece 2*b* is electrically connected to said one lead pin 3*a* at one end of said third core piece 2*c*, whereas, the other end B3 of said third internal heating coil segment 4*c* is electrically connected to said other lead pin 3*b* at the other end of said third core piece 2*c*.

Figure 5:
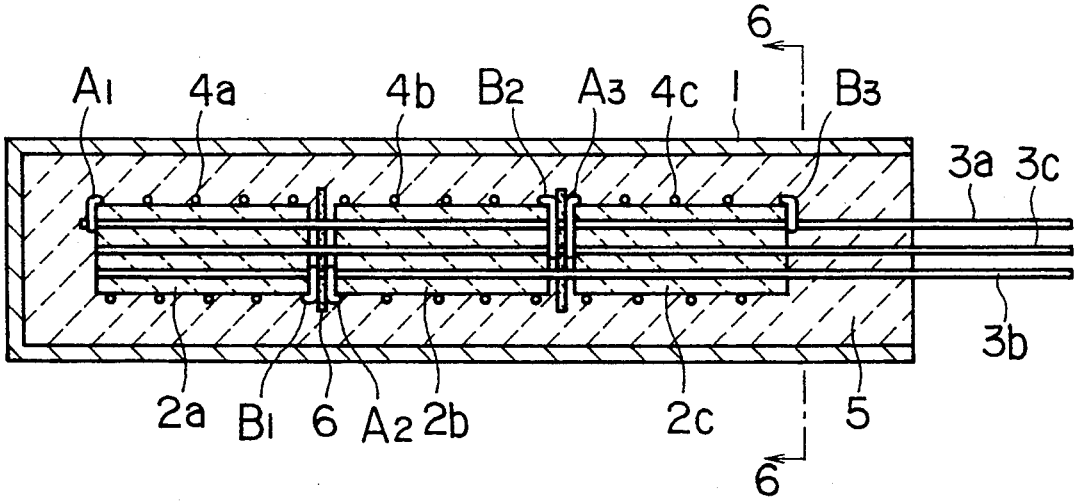
FIG. 5 is a sectional view of a sheathed heater to be connected across a three-phase electric power source according to the other embodiment of the present invention.
Figure 6:
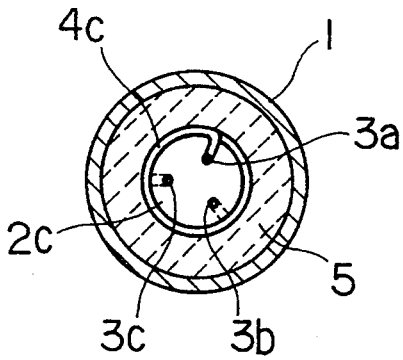
FIG. 6 is a sectional view taken along a line 6—6 in FIG. 5.

FIGS. 5 and 6 show a sheathed heater to be connected across a three-phase electric power source according to the other embodiment of the present invention.

In this embodiment, three small holes separated in the circumferential direction from one another are formed in and passing through each of first to three core pieces 2*a* to 2*c* of porcelain insulator, and three lead pins 3*a* to 3*c* are inserted into said first to three small holes, respectively. As the first embodiment, one end A1 of a first internal heating coil segment 4*a* wound around said first core piece 2*a* is electrically connected to said first lead pin 3*a* at one end of said first core piece 2*a*, the other end B1 of said first internal heater coil segment 4*a* is electrically connected to said second lead pin 3*b* at the other end of said first core piece 2*a*, an end A2 of a second internal heating coil segment 4*b* wound around said second core piece 2*b* adjacent to said first core piece 2*a* is electrically connected to said second lead pin 3*b* at one end of said second core piece 2*b*, and the other end B2 of said second internal heating coil element 4*b* is electrically connected to said third lead pin 3*c* at the other end of said second core piece 2*b*.

Similarly, an end of A3 of a third internal heating coil segment 4*c* wound around said third core piece 2*c* adjacent to said second core piece 2*b* is electrically connected to said third lead pin 3*c* at one end of said third core piece 2*c*, whereas, the other end B3 of said third internal heating coil segment 4*c* is electrically connected to said first lead pin 3*a* at the other end of said third core piece 2*c*.

Said three lead pins are electrically connected across a three-phase electric power source, respectively.

EFFECT OF THE INVENTION

As stated above, in the present invention, no voltage difference is formed between the adjacent ends of the internal heating coil segments adjacent to each other, such as B1–A2, B2–A3, because these are electrically connected to the same lead pin, or lead pins of the same electric potential.

Accordingly, the abnormal current is prevented from flowing between said adjacent lead pins, so that the service life of the sheathed heater can be prolonged.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A sheathed heater comprising a cylindrical metal sheath, a plurality of rod shaped insulator core pieces arranged in separated end to end adjacent relationship within said cylindrical metal sheath, a thermal and electrical insulation material filled in a space formed between said metal sheath and said core pieces, a plurality of internal heater coil segments each of said coil segments being wound around a different one of said core pieces and having opposed terminals located at opposite ends of said different one of said core pieces, and two lead pins separated from each other and inserted into said core pieces, wherein the opposed terminals of each of said coil segments are connected to different lead pins, adjacent terminals of adjacent internal heater coil segments are connected to the same of said two lead pins and said two lead pins are connected across a single-phase electric power source.

2. A sheathed heater comprising a cylindrical metal sheath, a plurality of rod shaped insulator core pieces arranged in separated end to end adjacent relationship within said cylindrical metal sheath, a thermal and electrical insulation material filled in a space formed between said metal sheath and said core pieces, a plurality of internal heater coil segments each of said coil segments being wound around a different one of said core pieces and having opposed terminals located at opposite ends of said different one of said core pieces, and three lead pins separated from each other and inserted into said core pieces, wherein the opposed terminals of each of said coil segments are connected to different lead pins, adjacent terminals of adjacent internal heater coil segments are connected the same of said three lead pins, and said three lead pins are connected across a three-phase electric power source.

3. The sheathed heater according to claim 2, wherein said three lead pins are separated from one another in a circumferential direction.

4. A sheathed heater comprising a cylindrical metal sheath, a plurality of rod shaped insulator core pieces arranged in separated end to end adjacent relationship within said cylindrical metal sheath, spacers of thermal electrical insulation material inserted between adjacent core pieces, a thermal and electrical insulation material filled in a space formed between said metal sheath and said core pieces, a plurality of internal heater coil segments each of said coil segments being wound around a different one of said core pieces and having opposed terminals located at opposite ends of said different one of said core pieces, and two lead pins separated from each other and inserted into said core pieces and spacers, wherein the opposed terminals of each of said coil segments are connected to different lead pins, adjacent terminals of adjacent internal heater coil segments are connected to the same of said two lead pins, and said two lead pins are connected across a single-phase electric power source.

5. A sheathed heater comprising a cylindrical metal sheath, a plurality of rod shaped insulator core pieces arranged in separated end to end adjacent relationship with said cylindrical metal sheath, spacers of thermal electrical insulation material inserted between adjacent core pieces, a thermal and electrical insulation material filled in a space formed between said metal sheath and said core pieces, a plurality of internal heater coil segments each of said coil segments being wound around a different one of said core pieces and having opposed terminals located at opposite ends of said different one of said core pieces, and three lead pins separated from each other and inserted into said core pieces and spacers, wherein the opposed terminals of each of said coil segments are connected to different lead pins, adjacent terminals of adjacent internal heater coil segments are connected to the same of said three lead pins, and said three lead pins are connected across a three-phase electric power source.

6. The sheathed heater according to claim 5, wherein said three lead pins are separated from one another in a circumferential direction.

* * * * *